US006287419B1

(12) United States Patent
Takeuchi et al.

(10) Patent No.: US 6,287,419 B1
(45) Date of Patent: Sep. 11, 2001

(54) WATER-DECOMPOSABLE NON-WOVEN FABRIC OF REGENERATED CELLULOSE FIBERS OF DIFFERENT LENGTHS

(75) Inventors: Naohito Takeuchi; Takayoshi Konishi, both of Kagawa (JP)

(73) Assignee: Uni-Charm Corportation, Kawanoe (JP)

( * ) Notice: Subject to any disclaimer, the term of this patent is extended or adjusted under 35 U.S.C. 154(b) by 0 days.

(21) Appl. No.: 09/528,776

(22) Filed: Mar. 17, 2000

(30) Foreign Application Priority Data

Mar. 23, 1999 (JP) ..... 11-077976

(51) Int. Cl.[7] ..... D21H 13/08

(52) U.S. Cl. ..... 162/115; 146/149; 146/157.6; 146/157.7

(58) Field of Search ..... 162/115, 109, 162/146, 149, 157.6, 157.7; 28/104, 105, 107; 442/408

(56) References Cited

U.S. PATENT DOCUMENTS

| | | | |
|---|---|---|---|
| 3,563,241 | 2/1971 | Evans et al. | 128/284 |
| 5,437,908 | 8/1995 | Demura et al. | 428/154 |

FOREIGN PATENT DOCUMENTS

| | | |
|---|---|---|
| 0945536 A2 | 9/1999 | (EP) . |
| 1510667 | 5/1978 | (GB) . |
| H3-292924 | 12/1991 | (JP) . |
| H6-198778 | 7/1994 | (JP) . |
| H7-24636 | 3/1995 | (JP) . |
| 09228214 | 9/1997 | (JP) . |
| WO 98/44181 | 9/1998 | (WO) . |

*Primary Examiner*—Peter Chin
(74) *Attorney, Agent, or Firm*—Darby & Darby

(57) ABSTRACT

There is disclosed a water-decomposable non-woven fabric including a first regenerated cellulose fiber having a fiber length of 3 mm or more to 5 mm or less, a second regenerated cellulose fiber having a fiber length of 6 mm or more to 10 mm or less, and a natural fiber having a fiber length of 10 mm or less, in which at least the second cellulose fiber is entangled with at least one of the first regenerated cellulose fiber, the second regenerated cellulose fiber and the natural fiber. This water-decomposable non-woven fabric is bulky with soft touch, and is also excellent in both water decomposability and wet strength.

18 Claims, No Drawings

WATER-DECOMPOSABLE NON-WOVEN FABRIC OF REGENERATED CELLULOSE FIBERS OF DIFFERENT LENGTHS

BACKGROUND OF THE INVENTION

1. Field of the Invention

The present invention relates to a water-decomposable non-woven fabric capable of being readily decomposed and dispersed in water flow. More precisely, it relates to a water-decomposable non-woven fabric having high strength in wet but capable of being readily decomposed in water.

2. Description of the Related Art

To wipe the skin of human bodies including the private parts thereof, or to clean toilets and thereabouts, used are cleaning sheets made of paper or non-woven fabric. The cleaning sheets must be decomposable in water so that they could be directly disposed of in toilets after their use. This is because, if hardly water-decomposable cleaning sheets are disposed of in toilets after their use, they will take a lot of time until they are decomposed and dispersed in septic tanks, or will clog the drainpipes around toilets.

For easy and effective use, many disposable cleaning sheets for wiper applications are packaged while being wetted with a cleaning chemical or the like, and are put on the market. Such cleaning sheets must have high strength in wet to such a degree that they are well fit for wiping with them containing a cleaning chemical or the like, but must well decompose in water after they are disposed of in toilets.

For example, Japanese Patent Publication No. 24636/1995 discloses a water-decomposable cleaning article that comprises a carboxyl group-having, water-soluble binder, a metal ion and an organic solvent. However, the metal ion and the organic solvent irritate the skin.

Japanese Patent Laid-Open No. 292924/1991 discloses a water-decomposable cleaning article of polyvinyl alcohol-containing fibers with an aqueous solution of boric acid infiltrated thereinto; and Japanese Patent Laid-Open No. 198778/1994 discloses a water-decomposable napkin of polyvinyl alcohol-containing non-woven fabric with a borate ion and a bicarbonate ion introduced thereinto. However, polyvinyl alcohol is not resistant to heat, and therefore the wet strength of the water-decomposable cleaning article and the water-decomposable napkin is lowered at 40° C. or higher.

On the other hand, Japanese Patent Laid-Open No. 228214/1997 discloses a water-degradable non-woven fabric having a wet strength of from 100 to 800 gf/25 mm as measured according to JIS P-8135, which is produced by mixing fibers having a length of from 4 to 20 mm with pulp followed by entangling them through treatment with high-pressure water jets. Since the constituent fibers are entangled in it, the non-woven fabric disclosed has a bulky feel. However, in producing the non-woven fabric, long fibers are entangled through high-pressure water jet treatment, whereby the non-woven fabric produced could have such a relatively high wet strength. Therefore, according to the technique disclosed, it is difficult to realize well-balanced bulkiness, strength and water-degradability for the non-woven fabric produced, and the non-woven fabric produced is unsuitable to disposal in flush toilets, etc.

SUMMARY OF THE INVENTION

The present invention is to solve the problems in the related art noted above, and its one object is to provide a water-decomposable non-woven fabric which is well decomposed in water and has high wet strength to such a degree that it is well usable in wet even though no binder is added thereto.

Another object of the invention is to provide a water-decomposable non-woven fabric having well balanced wet strength and decomposability in water, even though a relatively smaller amount of binder is added thereto than that in prior art.

The invention provides a water-decomposable non-woven fabric comprising a first regenerated cellulose fiber having a fiber length of 3 mm or more to 5 mm or less, a second regenerated cellulose fiber having a fiber length of 6 mm or more to 10 mm or less, and a natural fiber having a fiber length of 10 mm or less, wherein at least the second cellulose fiber is entangled (or interwoven) with at least one of the first regenerated cellulose fiber, the second regenerated cellulose fiber and the natural fiber.

The water-decomposable non-woven fabric of the invention can keep sufficient strength during wiping works, even when it contains water. In addition, when it is immersed in a large amount of water after used, it is readily decomposed. Therefore, after used, it can be disposed of in toilets, etc. What is more, the water-decomposable non-woven fabric of the invention is highly bulky with soft touch and is composed of materials not harmful to human bodies.

In accordance with the invention, preferably, both the first regenerated cellulose fiber and the second regenerated cellulose fiber have a fineness of 12 denier or less, more preferably, a fineness of 7 denier or less. Furthermore, it is preferable that one of the first and second cellulose fibers has a fineness of more than one denier, while the remaining one has a fineness of one denier or less. In this case, preferably, the fineness (denier value) of the first regenerated cellulose fiber is smaller than the fineness (denier value) of the second regenerated cellulose fiber.

In accordance with the invention, as to the aspect ratio represented by the formula (fiber length divided by denier value)×1,000, the first and second regenerated cellulose fibers are preferably at an aspect ratio of 400 or more to 14,000 or less. In this case, preferably, the first regenerated cellulose fiber is at an aspect ratio of 400 or more to 3,000 or less, while the second regenerated cellulose fiber is at an aspect ratio more than 3,000 to 14,000 or less; and the aspect ratio of the second regenerated cellulose fiber is larger by 300 or more than the aspect ratio of the first regenerated cellulose fiber.

In accordance with the invention, the content of the first and second regenerated cellulose fibers preferably resides in the range of 10 to 50% by weight.

In accordance with the invention, the basis weight (This may be referred to as "METSUKE") of the water-decomposable non-woven fabric is preferably 30 to 80 g/m$^2$.

In accordance with the invention, furthermore, the natural fiber is preferably soft-wood pulp.

The water decomposability of the water-decomposable non-woven fabric of the invention as measured according to JIS P-4501 is preferably at 150 seconds or less. On the other hand, the wet strength of the water-decomposable non-woven fabric of the invention is preferably 100 g/25 mm or more.

The water-decomposable non-woven fabric of the invention can be produced by entangling the fibers at water jetting treatment.

In the water-decomposable non-woven fabric of the invention, additionally, the wet strength thereof can be further enhanced without prominent reduction of the water decomposability, by allowing the water-decomposable non-woven fabric to contain a water-soluble or water-swellable binder. When the water-decomposable non-woven fabric contains the binder, preferably, the water-decomposable non-woven fabric further contains a water-soluble inorganic salt and/or a water-soluble organic salt. Furthermore, it is preferable that the binder is alkyl cellulose, while the water-decomposable non-woven fabric further contains (A) copolymer of a polymerizable acid anhydride compound with another compound; and/or (B) amino acid derivative.

DETAILED DESCRIPTION OF THE INVENTION

The water-decomposable non-woven fabric of the invention can be produced by mixing together a first regenerated cellulose fiber having a relatively short fiber length, a second regenerated cellulose fiber having a relatively long fiber length and a natural fiber having a fiber length of 10 mm or less, and subjecting a fiber web comprising these fibers to for example water-jetting treatment whereby the fibers are entangled together. The water-decomposable non-woven fabric can procure enhanced wet strength by entangling the second regenerated cellulose fiber together and/or entangling the second regenerated cellulose fiber with the first regenerated cellulose fiber and/or the natural fiber. These fibers composing the water-decomposable non-woven fabric can be readily separated from each other when kept in contact with a large amount of water, owing to the presence of the first regenerated cellulose fiber and the natural fiber between the fibers of the second regenerated cellulose fiber.

The fiber length of the first regenerated cellulose fiber is 3 mm or more to 5 mm or less. If the fiber length of the first regenerated cellulose fiber is shorter than the lower limit, the fibers constituting the non-woven fabric could not be entangled to a desired degree at the water-jetting treatment. If so, the wet strength of the resulting non-woven fabric will be low. On the other hand, the fiber length of the second regenerated cellulose fiber is 6 mm or more to 10 mm or less. If the fiber length of the second regenerated cellulose fiber is longer than the upper limit, the fibers constituting the non-woven fabric will be entangled too much at the water-jetting treatment. In that condition, the water decomposability of the resulting non-woven fabric will be poor. Herein, the difference in fiber length between the first and second regenerated cellulose fibers is preferably at least 3 mm or more, more preferably 4 mm or more.

The water decomposability and wet strength of the water-decomposable non-woven fabric of the invention are greatly influenced by the fineness of the first and second regenerated cellulose fibers in terms of denier. The fineness of first and second regenerated cellulose fibers for use in the invention is preferably 12 denier or less. If the fineness is larger than 12 denier, the formation of the non-woven fabric will be not good and, in addition, the productivity thereof will be low. More preferably, the fineness of the first and second regenerated cellulose fibers is 7 denier or less.

In case that the fineness of the first regenerated cellulose fiber is larger than that of the second regenerated cellulose fiber, both the first regenerated cellulose fiber having a relatively short fiber length and the natural fiber having a fiber length of 10 mm or less can be readily interposed (without entanglement) between the fibers of the second regenerated cellulose fiber having a relatively long fiber length. Therefore, the fibers constituting the non-woven fabric are prevented from being entangled to an excessive degree, so that the fibers can be readily separated from each other when in contact with a large amount of water. In this case, for example, the fineness of the first regenerated cellulose fiber is preferably 1.0 to 7.0 denier, while the fineness of the second regenerated cellulose fiber is preferably 0.5 to 3.0 denier.

Preferably, one of the first and second regenerated cellulose fibers has the fineness of more than 1.0 denier, while the remaining one has the fineness of 1.0 denier or less. In this case, more preferably, the fineness of the first regenerated cellulose fiber is 1.0 denier or less.

When the fineness of the first regenerated cellulose fiber is 1.0 denier or less and that of the second regenerated cellulose fiber is from more than 1.0 denier to 7.0 denier or less, the first regenerated cellulose fiber can readily be entangled with other fibers to thereby enhance the wet strength of the resulting water-decomposable non-woven fabric. Compared with a water-decomposable non-woven fabric formed only of the second regenerated cellulose fiber having a fineness of more than 1.0 denier to 7.0 denier or less and the natural fiber, accordingly, a water-decomposable non-woven fabric produced by replacing a part of the second regenerated cellulose fiber with the first regenerated cellulose fiber having a fineness of 1.0 denier or less can get higher wet strength (see Table 4). Here, because the fiber length of the first regenerated cellulose fiber is as short as 3 to 5 mm, the resulting water-decomposable non-woven fabric is readily decomposed in water when in contact with a large amount of water, although the water-decomposable non-woven fabric has higher wet strength. In other words, both the wet strength and the water decomposability are excellent.

The fiber lengths and denier values of fineness of the first and second regenerated cellulose fibers may be defined by the aspect ratio represented by the formula (fiber length divided by denier value)×1,000. In order to provide the water-decomposable non-woven fabric with excellent water decomposability and wet strength, therefore, the aspect ratios of the first and second regenerated cellulose fibers are preferably 400 or more to 14,000 or less. The aspect ratio varies, depending on the fiber length and fineness. Because the first and second regenerated cellulose fibers are different in fiber length, the fineness (denier values) of the first and second regenerated cellulose fibers may be the same or different. For example, there may be a combination of a regenerated cellulose fiber having a fineness of 7.0-denier and a fiber length of 3-mm at an aspect ratio of 428 and a regenerated cellulose fiber having a fineness of 0.5-denier and a fiber length of 7-mm at an aspect ratio of 14,000; or a combination of a regenerated cellulose fiber having a fineness of 1.0-denier and a fiber length of 3-mm at an aspect ratio of 3,000 and a regenerated cellulose fiber having a fineness of 3.0-denier and a fiber length of 10-mm at an aspect ratio of 3,333.

In order to further enhance the water decomposability and wet strength of the water-decomposable non-woven fabric of the invention, it is preferable that the aspect ratio of the first regenerated cellulose fiber is 400 or more to 3,000 or less and the aspect ratio of the second regenerated cellulose fiber is more than 3,000 to 14,000 or less and that the aspect ratio of the second regenerated cellulose fiber is larger by 300 or more than the aspect ratio of the first regenerated cellulose fiber.

The first and second regenerated cellulose fibers may be blended at an equal amount. In case that the fineness of the first regenerated cellulose fiber is large, however, the first regenerated cellulose fiber is preferably at a higher content so as to improve the water decomposability.

As described above, the water-decomposable non-woven fabric of the invention contains the natural fiber having a fiber length of 10 mm or less, in addition to the first and second regenerated cellulose fibers. For this natural fiber, use is preferably made of a fiber with good dispersibility in water, namely water-dispersible fiber. The term "dispersibility in water" as used herein essentially expresses the same meaning as that of the term "water decomposability", such that fibers are separated and dissociated from each other when in contact with a large amount of water. Here, the term "fiber length" as used in the invention means average fiber length. The natural fiber includes those from wood pulp such as soft wood pulp and hard wood pulp, Manila hemp, linter pulp, etc. These natural fibers are biodegradable.

Among these natural fibers, soft wood pulp having a fiber length of 3 to 4.5 mm is preferable from the respect of water decomposability. When the non-woven fabric containing the soft wood pulp is in contact with a large amount of water, the pulp swells and is then dissociated from the non-woven fabric, to permit the regenerated cellulose fibers therein to be readily decomposable in water. Hence, the water decomposability of the non-woven fabric is enhanced. For the soft wood pulp, its degree of beating preferably falls between 500 and 700 cc or so. The degree of beating is measured in terms of Canadian Standard Freeness. If the degree of beating is smaller than the defined range, the non-woven fabric will have a paper-like morphology, and will have a rough feel. If, however, the degree of beating is larger than the defined range, the non-woven fabric could not have high wet strength.

In addition to the first and second regenerated cellulose fibers having different fiber lengths and the natural fiber having a fiber length of 10 mm or less, the water-decomposable non-woven fabric of the invention may further contain additional fibers. The additional fibers include, for example, chemical fibers, synthetic fibers of polypropylene, polyvinyl alcohol, polyester, polyacrylonitrile, etc, biodegradable synthetic fibers, and synthetic pulp of polyethylene, etc. For the additional fibers, moreover, a fibrillated rayon may be used. The fibrillated rayon is a regenerated cellulose fiber with its surface finely fibrillated, namely, a regenerated cellulose fiber from the surface of which microfibers of a submicron thickness are peeled off. Furthermore, preferably, the fibers to be added are biodegradable, because the resulting water-decomposable non-woven fabric can be degraded even when disposed in the natural world.

As has been described above, the water-decomposable non-woven fabric is composed of the first and second regenerated cellulose fibers, the natural fiber having a fiber length of 10 mm or less, and optionally also the additional fibers. From the respects of water decomposability and wet strength, the blend ratio of these fibers is preferably such that the first and second regenerated cellulose fibers are at a content of 10 to 70% by weight and the remaining fiber is at a content of 30 to 90% by weight. More preferably, the blend ratio is such that the first and second regenerated cellulose fibers are at a content of 10 to 50% by weight and the remaining fiber is at a content of 50 to 90% by weight. Most preferably, the blend ratio is such that the first and second regenerated cellulose fibers are at a content of 20 to 50% by weight and the remaining fiber is at a content of 50 to 80% by weight. Here, the term "remaining fiber" indicates the natural fiber having a fiber length of 10 mm or less and the additional fibers if present. Although only two types of regenerated cellulose fibers are used in the above, three or more types of regenerated cellulose fibers varied in fiber length or aspect ratio may be used in combination, satisfactorily. Even when the non-woven fabric contains such three or more types of regenerated cellulose fibers, the preferable content of the regenerated cellulose fibers is the same as described above. Moreover, in any case, the content of the natural fiber (% by weight) is preferably equal to or more than that of the regenerated cellulose fibers.

In accordance with the invention, the basis weight (METSUKE) of the fibers is preferably 30 to 80 g/m$^2$ when the non-woven fabric is to be used for wiping work in a wet state. If the basis weight is below the lower limit, the non-woven fabric cannot have necessary wet strength. If the basis weight is above the upper limit, the non-woven fabric lacks softness. When it is to be used for human skin or the like, particularly, the basis weight of the fibers is preferably 40 to 60 g/m$^2$ from the point of view of wet strength and soft feel.

The non-woven fabric of the invention may be produced by forming a fiber web from the fibers in a wet process, followed by subjecting the fiber web to water-jetting treatment. The fiber web referred to herein is meant to indicate a sheet as prepared by sheeting a fiber block in such a manner that the fibers constituting it are oriented in some degree in a predetermined direction. The fiber web may also be prepared in a dry process, and may be subjected to water-jetting treatment. For the water-jetting treatment, employed is an ordinary high-pressure water-jetting device. Through the water-jetting treatment, the fiber web is formed into a non-woven fabric that is bulky as a whole and has a soft feel like cloth.

The details of the water-jetting treatment are described. The fiber web is put on a continuously moving conveyor belt, and exposed to high-pressure water-jetting streams to such a degree that the streams applied thereto could pass through its back surface. Through the water-jetting treatment, the properties of the non-woven fabric are changed, depending on the basis weight of the fiber web processed, the pore diameter of the jetting nozzle used, the number of pores of the jetting nozzles, the feeding speed at which the fiber web is processed with the water-jetting streams (processing speed), etc. Preferably, the water-jetting treatment is carried out in such a manner that the work done calculated by the following formula is 0.05 to 0.5 kW/m$^2$ in one treatment for one surface of the fiber web:

$$\text{Work done (kW/m}^2\text{)} = \{1.63 \times \text{jetting pressure (kgf/cm}^2) \times \text{jetting flow rate (m}^3\text{/min)}\}/\text{processing speed (m/min)}.$$

Above the upper limit, the fibers may be entangled too much so that the decomposability in water of the resulting non-woven fabric will be lowered, or the fiber web may be broken. Below the lower limit, on the other hand, the processed non-woven fabric could not be bulky to a desired degree. One or both surfaces of the fiber web may undergo the water-jetting treatment. For example, one cycle of the water-jetting treatment at 0.05 to 0.5 kW/m$^2$ over one surface of the fiber web can yield a non-woven fabric with preferable water decomposability and wet strength. Alternatively, both surfaces of the fiber web, namely the back surface and front surface of the fiber web, may be subjected to one cycle of the water-jetting treatment at 0.05 to 0.5 kW/m$^2$, respectively. Additionally, the water-jetting treatment at 0.05 to 0.5 kW/m$^2$ is preferably carried out at a water jet hydraulic energy of for example about 5 to 60 kgf/cm$^2$.

In case that the work done is set as above, additionally, the water-jetting device is preferably equipped with nozzles which have an orifice diameter of 90 to 100 microns and are arranged at intervals of 0.3 to 2.0 mm in the cross direction (CD) of the fiber web, so as to entangle the fibers to an appropriate degree.

After having been formed, it is desirable that the fiber web is directly subjected to the water-jetting treatment without being dried, for simplifying the process for the treatment. However, the fiber web may be subjected to the water-jetting treatment after having been once dried.

The water-decomposable non-woven fabric of the invention can also be produced by a process of entangling the fibers together by use of needle, air or the like, with no limitation to the water-jetting treatment.

Preferably, the strength at break in wet of the water-decomposable non-woven fabric of the invention that contains water is at least 100 g/25 mm in terms of the root of the product obtained by multiplying the strength in the machine direction (MD) by that in the cross direction (CD). The strength at break in wet (this is herein referred to as wet strength) is meant to indicate the tensile strength at break (gf) of the non-woven fabric in wet. To obtain its wet strength in terms of the tensile strength at break, a test piece of the non-woven fabric having a width of 25 mm and a length of 150 mm is immersed in water to thereby infiltrate water of 2.5 times the weight of the non-woven fabric into the test piece, and the thus-wetted test piece is pulled until it is broken, by the use of a Tensilon tester, for which the chuck distance is 100 mm and the stress rate is 100 mm/min.

However, the data thus measured according to the method are merely the criterion for the strength of the non-woven fabric, and the non-woven fabric of the invention will be comfortably used for wiping purposes so far as it has strength that is substantially the same as the wet strength (at least 100 g/25 mm) measured in the manner as above. More preferably, the wet strength of the non-woven fabric is at least 130 g/25 mm.

Also preferably, the water-decomposable non-woven fabric of the invention has a degree of decomposition in water of at most 150 seconds. The degree of decomposition in water is measured according to the test method of JIS P-4501 that indicates the degree of easy degradation of toilet paper in water. The outline of the paper degradation test method is described. A piece of the water-decomposable non- woven fabric of the invention having a length of 10 cm and a width of 10 cm is put into a 300-ml beaker filled with 300 ml of ion-exchanged water, and stirred therein with a rotor. The revolution speed of the rotor is 600 rpm. The condition of the test piece being dispersed in water is macroscopically observed, and the time until the test piece is finely dispersed is measured.

However, the data thus measured according to the method are merely the criterion for the decomposability in water of the non-woven fabric, and the non-woven fabric of the invention will be disposed of in flush toilets and others with no problem so far as it has a degree of decomposition in water that is substantially the same as the data (at most 150 seconds) measured in the manner as above. More preferably, the non-woven fabric of the invention has a degree of decomposition in water of at most 100 seconds.

Even though not containing a binder, the water-decomposable non-woven fabric of the invention could have a high degree of decomposition in water and high wet strength. However, in order to further increase the wet strength of the non-woven fabric, a water-soluble or water-swellable binder capable of binding fibers together may be added to the non-woven fabric. Even in such a case, because the water-decomposable non-woven fabric of the invention has excellent water decomposability and wet strength from the first, a binder of a smaller amount than those of binders for use in conventional water-decomposable non-woven fabrics can yield a water-decomposable non-woven fabric with more excellent water decomposability and far higher wet strength.

The binder includes, for example, carboxymethyl cellulose; alkyl celluloses such as methyl cellulose, ethyl cellulose, benzyl cellulose, etc.; polyvinyl alcohol; modified polyvinyl alcohols having a predetermined amount of a sulfonic group or a carboxyl group, etc. The amount of the binder to be added to the non-woven fabric may be small. For example, only about 1 to 7 g (preferably, about 2 g) of the binder, relative to 100 g of the fibers constituting the non-woven fabric, may be added to the non-woven fabric whereby the wet strength of the non-woven fabric could be much increased. As being soluble or swellable in water, the binder dissolves or swells in water when kept in contact with a large amount of water. To add the water-soluble binder to the non-woven fabric, employable is a coating method of applying the binder to the non-woven fabric through a silk screen. On the other hand, the water-swellable binder may be added to the fiber web for the non-woven fabric while the fiber web is prepared in a paper-making process.

Where the binder is added to the non-woven fabric of the invention, an electrolyte such as a water-soluble inorganic or organic salt may be added thereto along with the binder, whereby the wet strength of the non-woven fabric could be increased much more. The inorganic salt includes, for example, sodium sulfate, potassium sulfate, zinc sulfate, zinc nitrate, potassium alum, sodium chloride, aluminium sulfate, magnesium sulfate, potassium chloride, sodium carbonate, sodium hydrogencarbonate, ammonium carbonate, etc.; and the organic salt includes, for example, sodium pyrrolidone-carboxylate, sodium citrate, potassium citrate, sodium tartrate, potassium tartrate, sodium lactate, sodium succinate, calcium pantothenate, calcium lactate, sodium laurylsulfate, etc. Where an alkyl cellulose is used as the binder, it is preferably combined with a salt having a monovalent ion. In particular, sodium sulfate is the most preferable because it can increase the wet strength of the water-decomposable non-woven fabric in a greater degree. Where a modified or non-modified polyvinyl alcohol is used as the binder, it is also preferably combined with a salt having a monovalent ion.

In addition, where an alkyl cellulose is used as the binder, any of the following compounds may be added to the water-decomposable non-woven fabric so as to further increase the wet strength of the non-woven fabric. For example, the additional compounds include (A) copolymers of polymerizable acid anhydride compounds with other compounds; and (B) amino acid derivatives.

The copolymers (A) include compounds formed by copolymerizing a maleic anhydride or fumaric anhydride as an acid anhydride with methyl methacrylate, methyl acrylate, ethyl acrylate, ethyl methacrylate or butyl methacrylate, namely (meth)acrylate maleate-type resin, (meth)acrylate fumarate-type resin, vinyl acetate maleate-type resin, rosin-modified fumarate resin, methyl vinyl ether maleate resin, α-olefin maleate resin, α-olefin fumarate resin, isobutylene maleate resin, and pentene maleate resin. The copolymers are preferably used after saponification with sodium hydroxide or the like to partially modify the copolymers into water-soluble copolymers in the form of sodium carboxylate salt. In this case, the resulting copolymers dissolved in an aqueous solution of an alkyl cellulose can be coated, together with the alkyl cellulose, on the non-woven fabric. Alternatively, the resulting copolymers may be dissolved in water, along with other compounds such as (B). Then, the resulting mixture is added to the non-woven fabric. When an aqueous solution of the copolymer (A) is contained in the water-decomposable non-woven fabric, a concentration of the copolymer (A) is preferably 0.05 to 5.0% by weight. When the concentration of the copolymer (A) is below 0.05% by weight, the amino acid derivative (B) may be contained in the non-woven fabric, together with the copolymer (A). Alternatively, the amino acid derivative (B) may be contained in the non-woven fabric, in place of the copolymer (A).

The amino acid derivative (B) is a compound produced from an amino acid, by subjecting the amino acid to acylation, dehydration and condensation, esterification, neutralization of fatty acid, or polymerization. For example, the amino acid derivative (B) includes trimethyl glycine as an N-trialkyl-substituted glutamic acid; DL-pyrrolidone carboxylic acid, DL-pyrrolidone sodium carboxylate, and DL-pyrrolidone carboxylate triethanolamine, which are produced by subjecting glutamic acid to dehydration and condensation; N-coconut oil fatty acid acyl L-arginine ethyl DL-pyrrolidone carbonic acid produced by acylation and esterification of arginine, and poly(sodium aspartate) recovered by polymerizing aspartic acid. Among them, trimethyl glycine is particularly preferable because of its great safety profile and the increased wet strength of the resulting water-decomposable non-woven fabric. When an aqueous solution of the amino acid derivative (B) is contained in the water-decomposable non-woven fabric, a concentration of the amino acid derivative (B) is preferably 1 to 15% by weight. When the copolymer (A) is not contained in the water-decomposable non-woven fabric, preferably, the amino acid derivative (B) is at a concentration of 5% by weight or more in the aqueous solution. When the copolymer (A) is contained in the water-decomposable non-woven fabric, preferably, the amino acid derivative (B) is at a concentration of 1 to 5% by weight in the aqueous solution.

The water-decomposable non-woven fabric of the invention may optionally contain any other substances, without interfering with the advantages of the invention. For example, it may contain any of surfactants, microbicides, preservatives, deodorants, moisturizers, alcohols such as ethanol, polyalcohols such as glycerin, etc.

As having good decomposability in water and high wet strength, the water-decomposable non-woven fabric of the invention is usable as wet tissue for application to the skin of human bodies including the private parts thereof, or as cleaning sheets for toilets and thereabouts. To enhance its wiping and cleaning capabilities for those applications, the non-woven fabric may previously contain water, surfactant, alcohol, glycerin and the like. Where the water-decomposable non-woven fabric of the invention is, while being previously wetted with liquid detergent and the like, packaged for public sale, it shall be airtightly packaged and put on the market so that it is not spontaneously dried. On the other hand, the water-decomposable non-woven fabric may be marketed in dry. The users who have bought the dry water-decomposable non-woven fabric may wet it with water or liquid chemicals before use.

EXAMPLES

The invention is described in more detail with reference to the following Examples, which, however, are not intended to restrict the scope of the invention.

Example A

Regenerated cellulose fibers and bleached soft-wood kraft pulp (NBKP) (Canadian Standard Freeness, CSF=550 ml) in Table 1 were mixed together at ratios in Table 1; and fiber webs were produced according to a wet paper-making process for which was used a cylinder paper-making machine. In individual examples, regenerated cellulose fibers of variable denier values and fiber lengths were used at different blend ratios.

Without being dried but still on the plastic wire, the resulting fiber web put on a running conveyor. While being moved at the speed of 30.0 m/min, the fiber web was subjected to water-jetting treatment, whereby the fibers constituting it were entangled. The high-pressure water-jetting device used for the treatment was equipped with 2000 nozzles/meter each having an orifice diameter of 95 microns, at intervals of 0.5 mm between the adjacent nozzles, and the pressure of jetting water streams applied to the web was 30 $kgf/cm^2$. In that condition, jetting water was applied to one surface of the web so that it passes through its back surface. The water-jetting treatment was repeated once again under the same condition. Next, this was dried with a hot air drier to obtain a water-decomposable non-woven fabric. This was then wetted with 250 g, relative to 100 g of the weight of the non-woven fabric, of ion exchanged water. The thus-obtained water-decomposable non-woven fabric was tested for its degree of decomposition in water and its wet strength, according to the methods mentioned below.

The test for the decomposability in water was based on the test of JIS P-4501 indicating the degree of degradability of toilet paper. Precisely, a piece of the water-decomposable non-woven fabric having a length of 10 cm and a width of 10 cm was put into a 300-ml beaker filled with 300 ml of ion-exchanged water, and stirred therein with a rotor. The revolution speed of the rotor was 600 rpm. The condition of the test piece being dispersed in water was macroscopically observed, and the time until the test piece was finely dispersed was measured (see the following Table—the data are expressed in seconds).

The wet strength was measured according to the test method stipulated in JIS P-8135. Briefly, a piece of the non-woven fabric having a width of 25 mm and a length of 150 mm was tested both in the machine direction (MD) and in the cross direction (CD), by the use of a Tensilon tester, for which the chuck distance was 100 mm and the stress rate was 100 mm/min. The strength at break (gf) of the test piece thus measured indicates wet strength thereof The root of the product of the data in MD and the data in CD [√ (data in MD×data in CD)] was defined as the wet strength (see the following Table—the data are expressed in g/25 mm).

As Comparative Examples, non-woven fabrics each containing a single type of regenerated cellulose fiber were prepared and tested in the same manner as in Example A.

The results are shown in Table 1.

TABLE 1

| | Regenerated cellulose fibers (wt %) | | | | | | | | |
|---|---|---|---|---|---|---|---|---|---|
| Denier<br>Fiber length (mm)<br>Aspect ratio | 0.5<br>7<br>14000 | 1.0<br>7<br>7000 | 3.0<br>10<br>3333 | 1.0<br>3<br>3000 | 7.0<br>3<br>428 | Soft-wood pulp (wt %) | Basis weight ($g/m^2$) | Wet strength (g/25 mm) | Water decomposability (seconds) |
| Example A-1 | 10 | | | 30 | | 60 | 50.0 | 161 | 93 |
| Example A-2 | 10 | | | | 30 | 60 | 50.0 | 120 | 64 |
| Example A-3 | 20 | | | 20 | | 60 | 50.0 | 243 | 143 |
| Example A-4 | 20 | | | | 20 | 60 | 50.0 | 185 | 138 |
| Example A-5 | | 20 | | 20 | | 60 | 50.0 | 185 | 125 |
| Example A-6 | | 20 | | | 20 | 60 | 50.0 | 131 | 98 |
| Example A-7 | | | 20 | 20 | | 60 | 50.0 | 123 | 131 |
| Example A-8 | | | 20 | | 20 | 60 | 50.0 | 110 | 123 |
| Comparative Example 1 | 40 | | | | | 60 | 50.0 | 291 | 600 or more |
| Comparative Example 2 | | 40 | | | | 60 | 50.0 | 227 | 600 or more |
| Comparative Example 3 | | | 40 | | | 60 | 50.0 | 199 | 600 or more |
| Comparative Example 4 | | | | 40 | | 60 | 50.0 | 85 | 47 |
| Comparative Example 5 | | | | | 40 | 60 | 50.0 | 42 | 20 |

From Table 1, it is seen that the non-woven fabrics of Examples containing two types of regenerated cellulose fibers of different fiber lengths were in good balance of water decomposability and wet strength, compared with the non-woven fabrics of Comparative Examples containing only one type of regenerated cellulose fiber and NBKP.

Example B

In the same manner as in Example A, water-decomposable non-woven fabrics were prepared by using the regenerated cellulose fibers in Table 2. As shown in Table 2, however, these non-woven fabrics of Example B were different in basis weight. The water decomposability and wet strength of the resulting non-woven fabrics were measured in the same manner.

The results are shown in Table 2.

TABLE 2

| | Regenerated cellulose fibers (wt %) | | | | | | | | |
|---|---|---|---|---|---|---|---|---|---|
| Denier<br>Fiber length (mm)<br>Aspect ratio | 0.5<br>7<br>14000 | 1.0<br>7<br>7000 | 3.0<br>10<br>3333 | 1.0<br>3<br>3000 | 7.0<br>3<br>428 | Soft-wood pulp (wt %) | Basis weight ($g/m^2$) | Wet strength (g/25 mm) | Water decomposability (seconds) |
| Example B-1 | 10 | | | 30 | | 60 | 40.0 | 123 | 75 |
| Example B-2 | 10 | | | 30 | | 60 | 60.0 | 193 | 114 |
| Example B-3 | | 20 | | 20 | | 60 | 40.0 | 148 | 108 |
| Example B-4 | | 20 | | 20 | | 60 | 60.0 | 222 | 138 |
| Example B-5 | | 20 | | | 20 | 60 | 40.0 | 110 | 71 |
| Example B-6 | | 20 | | | 20 | 60 | 60.0 | 158 | 112 |
| Example B-7 | | | 20 | 20 | | 60 | 40.0 | 114 | 107 |
| Example B-8 | | | 20 | 20 | | 60 | 60.0 | 148 | 132 |
| Example B-9 | 10 | | | 30 | | 60 | 20.0 | 65 | 18 |
| Example B-10 | 10 | | | 30 | | 60 | 100.0 | 303 | 361 |
| Example B-11 | | 20 | | 20 | | 60 | 20.0 | 78 | 23 |
| Example B-12 | | 20 | | 20 | | 60 | 100.0 | 411 | 600 or more |
| Example B-13 | | | 20 | 20 | | 60 | 20.0 | 49 | 21 |

From Table 2, it is seen that, in the water-decomposable non-woven fabrics of the invention, the wet strength was lowered when the basis weight was 20 $g/m^2$; the water decomposability was lowered when the basis weight was 100 $g/m^2$. Therefore, the basis weight is preferably about 30 to 80 $g/m^2$. However, even when the basis weight of the water-decomposable non-woven fabric does not fall within the preferred range, the water-decomposable non-woven fabric can be prepared in good balance of water decomposability and wet strength by varying the fineness (denier values) of the regenerated cellulose fibers, the fiber lengths thereof, the blend ratio of the soft-wood pulp, etc.

Example C

As Example C-1, a water-decomposable non-woven fabric was prepared in the same manner as in Example A, by using the regenerated cellulose fibers in Table 3. The non-woven fabric of Example C-1 was impregnated with ion exchange water and then the water decomposability and wet strength thereof were measured in the same manner as in Example A. As Comparative Example, a non-woven fabric containing a single type of regenerated cellulose fiber was also prepared and tested in the same manner as in the Example A.

On the other hand, as Example C-2, the same water-decomposable non-woven fabric as in Example C-1 was prepared and coated with an aqueous solution of a mixture of alkyl cellulose and (meth)acrylate (ester) maleate copolymer (sodium salt) as binder. The amount of the binder coated was 2 $g/m^2$. Subsequently, the non-woven fabrics were impregnated with 250 g of a chemical solution (an aqueous solution containing 4 wt % sodium sulfate, 4 wt % trimethyl glycine and 10 wt % propylene glycol), relative to 100 g of the non-woven fabric. In the same manner as in Example A, the water decomposability and wet strength of the resulting chemical solution-impregnated non-woven fabric of Examples C-2 was measured. The basis weight of Examples C-2 in Table 3 was the value after binder coating.

The results are shown in Table 3.

TABLE 3

| | Regenerated cellulose fibers (wt %) | | | | | | |
|---|---|---|---|---|---|---|---|
| Denier<br>Fiber length (mm)<br>Aspect ratio | | 1.0<br>3<br>3000 | 3.0<br>10<br>3333 | Soft-wood pulp (wt %) | Basis weight ($g/m^2$) | Wet strength (g/25 mm) | Water decomposability (seconds) |
| Comparative Example 1 | no binder | | 40 | 60 | 50.0 | 199 | 600 or more |
| Comparative Example 2 | with binder | | 40 | 60 | 52.0 | 245 | 600 or more |
| Example C-1 | no binder | 20 | 20 | 60 | 50.0 | 123 | 131 |
| Example C-2 | with binder | 20 | 20 | 60 | 52.0 | 178 | 139 |

From Table 3, it is seen that wet strength can be raised with almost no reduction of water decomposability, when the binder is contained in the non-woven fabric of the invention.

Example D

As Example D, water-decomposable non-woven fabrics were prepared by using the regenerated cellulose fibers in Table 4 and tested in the same manner as in Example C. The results are shown in Table 4.

TABLE 4

| | Regenerated cellulose fibers (wt %) | | | | | | | |
|---|---|---|---|---|---|---|---|---|
| Denier<br>Fiber length (mm)<br>Aspect ratio | | 0.7<br>4<br>5714 | 1.0<br>4<br>4000 | 3.0<br>7<br>2333 | Soft-wood pulp (wt %) | Basis weight ($g/m^2$) | Wet strength (g/25 mm) | Water decomposability (seconds) |
| Comparative Example 1 | no binder | | | 40 | 60 | 50.0 | 75 | 330 |
| Example D-1 | no binder | | 20 | 20 | 60 | 50.0 | 118 | 112 |
| Example D-2 | | 20 | | 20 | 60 | 50.0 | 163 | 124 |
| Example D-3 | with binder | | 20 | 20 | 60 | 52.0 | 167 | 125 |
| Example D-4 | | 20 | | 20 | 60 | 52.0 | 226 | 133 |

From Table 4, it is seen that the non-woven fabrics of Examples D-1 and D-2 containing the first regenerated cellulose fibers of the small denier values have higher wet strength than the non-woven fabric of Comparative Example without the first regenerated cellulose fiber. Additionally, the water decomposability is never reduced but rather elevated on contrast. Thus, it is seen that both the water decomposability and wet strength of the water-decomposable non-woven fabric of the invention can be enhanced by adding the regenerated cellulose fiber of a shorter fiber length and a smaller denier value. Additionally, from Examples D-3 and D-4 in Table 4, it is also seen that a small amount of the binder coated on the water-decomposable non-woven fabric of the invention can enhance the wet strength without much reduction of the water decomposability.

As apparently shown insofar, in accordance with the invention, a water-decomposable non-woven fabric with good balance in water decomposability and wet strength can be prepared. Furthermore, the water-decomposable non-woven fabric of the invention is bulky with soft touch.

Moreover, by adding a binder to the water-decomposable non-woven fabric of the invention, the wet strength thereof can be enhanced more without interfering with the water decomposability. In this case, additionally, because the amount of the binder to be used can be made less than that used for conventional water-decomposable non-woven fabrics, the possibility of damaging the skin of users can be reduced.

The invention may be embodied in other specific forms without departing from the spirit or essential characteristics thereof the present embodiment is therefore to be considered in all aspects as illustrative and not restrictive, the scope of the invention being indicated by the appended claims rather than by the foregoing description and all changes which come within the meaning and range of equivalency of the claims are therefore intended to be embraced therein.

What is claimed is:

1. A water-decomposable non-woven fabric, comprising:

a first regenerated cellulose fiber having a fiber length of 3 mm to 5 mm, a second regenerated cellulose fiber having a fiber length of 6 mm to 10 mm, and a natural fiber having a fiber length of at most 10 mm, an aspect ratio of the first and second regenerated cellulose fibers being in a range between 400 and 14,000, the first and second regenerated cellulose fibers being present in an amount of 10–70% by weight, the natural fiber being present in an amount of 90–30% by weight, wherein the non-woven fabric is subjected to water jet treatment so that at least the second cellulose fiber is entangled with at least one of the first regenerated cellulose fiber, the second regenerated cellulose fiber and the natural fiber.

2. A water-decomposable non-woven fabric according to claim 1, wherein both the first regenerated cellulose fiber and the second regenerated cellulose fiber have a fineness of at most 12 denier.

3. A water-decomposable non-woven fabric according to claim 2, wherein both the first regenerated cellulose fiber and the second regenerated cellulose fiber have a fineness of at most 7 denier.

4. A water-decomposable non-woven fabric according to claim 2, wherein one of the first regenerated cellulose fiber and the second regenerated cellulose fiber has a fineness of more than one denier while the other has a fineness of at most one denier.

5. A water-decomposable non-woven fabric according to claim 4, wherein the fineness of the first regenerated cellulose fiber is smaller than the fineness of the second regenerated cellulose fiber.

6. A water-decomposable non-woven fabric according to claim 5, wherein the aspect ratio of the first regenerated cellulose fiber is between 400 and 3,000 and the aspect ratio of the second regenerated cellulose fiber is between 3,000 to 14,000 or less and wherein the aspect ratio of the second regenerated cellulose fiber is larger by at least 300 more than the aspect ratio of the first regenerated cellulose fiber.

7. A water-decomposable non-woven fabric according to claim 3, wherein one of the first regenerated cellulose fiber and the second regenerated cellulose fiber has a fineness of more than one denier while the other has a fineness of at most one denier.

8. A water-decomposable non-woven fabric according to claim 7, wherein the fineness of the first regenerated cellulose fiber is smaller than the fineness of the second regenerated cellulose fiber.

9. A water-decomposable non-woven fabric according to claim 8, wherein the aspect ratio of the first regenerated cellulose fiber is between 400 and 3,000 and the aspect ratio of the second regenerated cellulose fiber is between 3,000 and 14,000 and wherein the aspect ratio of the second regenerated cellulose fiber is larger by at least 300 more than the aspect ratio of the first regenerated cellulose fiber.

10. A water-decomposable non-woven fabric according to claim 1, wherein the aspect ratio of the first regenerated cellulose fiber is between 400 and 3,000 and the aspect ratio of the second regenerated cellulose fiber is between 3,000 to 14,000 and wherein the aspect ratio of the second regenerated cellulose fiber is at least 300 more than the aspect ratio of the first regenerated cellulose fiber.

11. A water-decomposable non-woven fabric according to claim 1, wherein the non-woven fabric contains the first regenerated cellulose fiber and the second regenerated cellulose fiber in an amount of 10 to 50% by weight.

12. A water-decomposable non-woven fabric according to claim 1, wherein the non-woven fabric has a basis weight of 30 to 80/m$^2$.

13. A water-decomposable non-woven fabric according to claim 1, wherein the natural fiber having a fiber length of at most 10 mm is soft-wood pulp.

14. A water-decomposable non-woven fabric according to claim 1, wherein water decomposability is at most 150 seconds.

15. A water-decomposable non-woven fabric according to claim 1, wherein wet strength is at least 100 g/25 mm.

16. A water-decomposable non-woven fabric according to claim 1, wherein the non-woven fabric contains one of a water-soluble and water-swellable binder.

17. A water-decomposable non-woven fabric according to claim 16, further comprising:

at least one of a water-soluble inorganic salt and a water-soluble organic salt.

18. A water-decomposable non-woven fabric according to claim 17, wherein the binder is alkyl cellulose and the water-decomposable non-woven fabric further contains at least one of (A) copolymer of an acid anhydride compound with another compound; and (B) amino acid derivative.

* * * * *

UNITED STATES PATENT AND TRADEMARK OFFICE

CERTIFICATE OF CORRECTION

PATENT NO. : 6,287,419 B1 
DATED : September 11, 2001
INVENTOR(S) : Naohito Takeuchi and Yakayoshi Konishi It is certified that error appears in the above-identified patent and that said Letters Patent is hereby corrected as shown below:

Title page,
Item [73], Assignee, change "Kawanoe (JP)" to -- Ehime (JP) --.

Signed and Sealed this

Fifteenth Day of October, 2002

*Attest:*

*Attesting Officer*

JAMES E. ROGAN
*Director of the United States Patent and Trademark Office*